United States Patent [19]

Kajiya et al.

[11] Patent Number: 4,557,169

[45] Date of Patent: Dec. 10, 1985

[54] CONTINUOUS TAG CUTTING/FEEDING APPARATUS

[75] Inventors: Hiroshi Kajiya; Hidetomo Sasaki, both of Tokyo, Japan

[73] Assignee: Kabushiki Kaisha Sato, Japan

[21] Appl. No.: 510,399

[22] Filed: Jul. 5, 1983

[30] Foreign Application Priority Data

Jul. 8, 1982 [JP] Japan ..... 57-102507

[51] Int. Cl.[4] ..... B26D 5/32

[52] U.S. Cl. ..... 83/156; 83/81; 83/211; 83/261; 493/370

[58] Field of Search ..... 493/370; 83/81, 82, 83/210, 211, 225, 261, 371, 156

[56] References Cited

U.S. PATENT DOCUMENTS

| | | | |
|---|---|---|---|
| 1,859,962 | 5/1932 | Ferenci | 83/261 |
| 2,802,529 | 8/1957 | Nifong | 83/81 |
| 4,353,274 | 10/1984 | Shimizu | 83/156 |
| 4,429,262 | 2/1984 | Vits | 83/24 |

*Primary Examiner*—Francis S. Husar
*Assistant Examiner*—William E. Terrell
*Attorney, Agent, or Firm*—Ostrolenk, Faber, Gerb & Soffen

[57] ABSTRACT

A continuous tag feeding and cutting apparatus for cutting a continuous tag strip into proper length tags. A first feeding mechanism feeds the strip of tags past the cutting mechanism to a second feeding mechanism, and a sensor halts the first feeding mechanism each time a sufficient length of the tag strip has been fed past the cutting mechanism. The cutting mechanism includes a rotary blade which is driven through one rotation cycle each time a length of tag strip is fed therepast by the first feeding mechanism. A second feeding mechanism located past the cutting mechansim is engaged with the tag strip for feeding a tag cut from the strip during one rotation of the blade to storage after the tag has been cut from the strip. The second feeding mechanism includes a driving roller which is driven to rotate along with the rotary blade and includes a driven roller which is engageable with the driving roller to engage the tag strip. A cam arrangement disengages the driven roller from the driving roller of the second feeding mechanism during the period prior to the cutting, during the cutting and after the cutting of the tag strip by the rotary blade, and causes the second feed mechanism to reengage the cut tag while the rotary blade is moving from the position after cutting back to the position prior to the next cutting.

5 Claims, 3 Drawing Figures

CONTINUOUS TAG CUTTING/FEEDING APPARATUS

BACKGROUND OF THE INVENTION

1. Field of the Invention

The present invention relates to a continuous tag cutting/feeding apparatus. More particularly, the present invention relates to a continuous tag cutting/feeding apparatus for feeding a tag strip and cutting it into individual tags each having a proper length and for delivering the cut tags into a stacker, or the like.

2. Description of the Prior Art

A conventional continuous tag cutting/feeding apparatus is used on a continuous tag cutting machine or a continuous tag printing machine. In such apparatus, a strip of tags is intermittently fed by a first feeding mechanism which comprises a driving roller and a cooperating driven roller. The strip is then cut into tags of proper lengths by a cutting mechanism which comprises a stationary blade and a cooperating rotary blade. Each cut tag is fed by a second feeding mechanism which comprises a driving roller and a cooperating driven roller. The driving roller of the second feeding mechanism is continuously rotated and the driven roller thereof is brought into tight contact with that driving roller. The tag is then delivered by the second feeding mechanism into a stacker, or the like.

In the conventional second feeding mechanism, since the driving roller is rotated continuously, during the cutting operation the leading end of the tag strip slips against the driving roller, while the driven roller is in tight contact with the driving roller. Therefore, the leading end of the strip is soiled or smeared by being rubbed between the rollers. Furthermore, since the forwardly directed feeding force of the driving roller acts on the leading end of the tag strip, during cutting, the strip may often tear before the cutting procedure is completed, resulting in inconvenience. Further still, the leading end of the strip of tags must be inserted between the driving and driven rollers which are brought into tight contact with each other every time the strip is cut to prepare a tag. A soft or perforated strip of tags may not be smoothly inserted between the rollers. In some cases, the strip becomes crumpled, resulting in inefficient cutting/feeding operation.

BRIEF SUMMARY OF THE INVENTION

It is, therefore, the principal object of the present invention to eliminate the above-described disadvantages of tag printing machines of the conventional art.

Another object of the present invention is to provide a continuous tag cutting/feeding apparatus wherein the leading end of a strip of tags may not be soiled or smeared by a second feeding mechanism, the strip may not accidentally tear before the cutting procedure is completed, and the leading end of the strip may be smoothly inserted between a driving roller and a driven roller of the second feeding mechanism.

Still another object of the present invention is to provide a simple, reliably operated continuous tag cutting/feeding apparatus.

In order to achieve the above and other objects of the present invention, an improved continuous tag cutting/feeding apparatus is provided. It comprises a first feeding mechanism for feeding a strip of tags and a cutting mechanism for cutting the strip into individual tags having a proper length by a stationary blade and a rotary blade. The rotary blade is rotated intermittently. A second feeding mechanism feeds each of the tags as it is inserted between a driving roller and a driven roller. A feed control mechanism connected with the rotary blade and with the second feed mechanism separates the driving roller of the second feeding mechanism from the driven roller thereof while the rotary blade is stopped prior to cutting and while cutting is being performed.

BRIEF DESCRIPTION OF THE DRAWINGS

The foregoing and other objects of the present invention will become more apparent from the following description of a preferred embodiment taken in connection with the accompanying drawings, in which.

DETAILED DESCRIPTION OF THE PREFERRED EMBODIMENT

A continuous tag cutting/feeding apparatus according to an embodiment of the present invention will be described with reference to the accompanying drawings.

Figure 1:
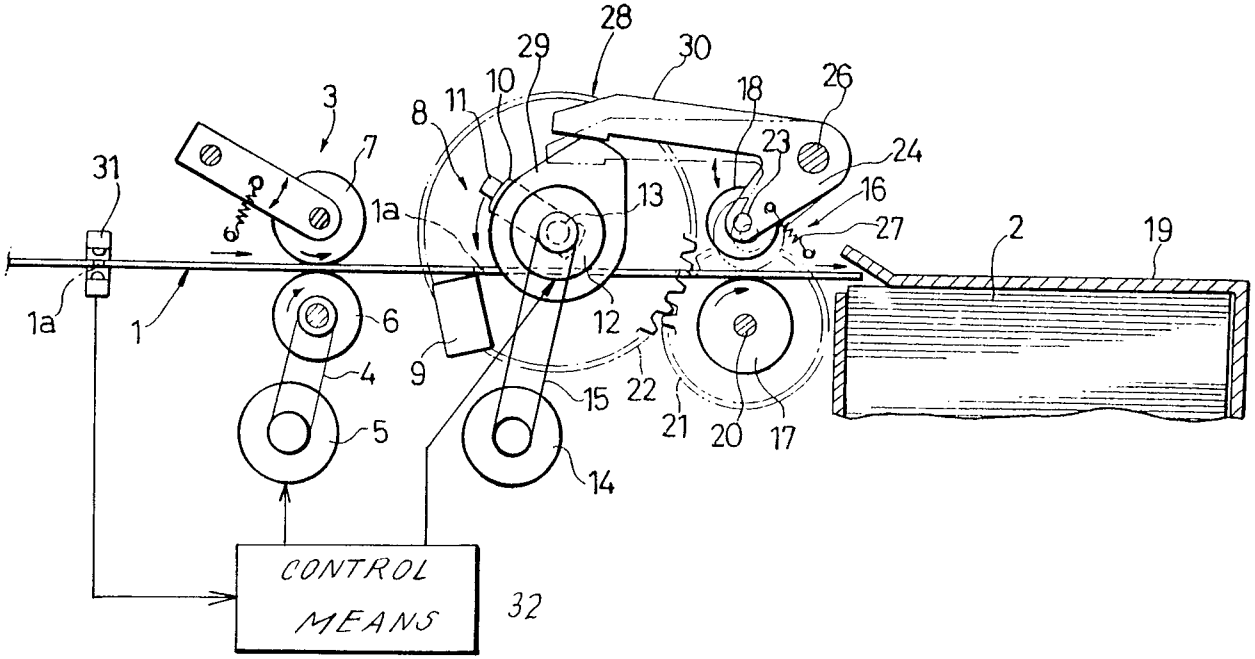
FIG. 1 is a partially sectional side view showing the overall construction of a continuous tag cutting/feeding apparatus.
Figure 2:
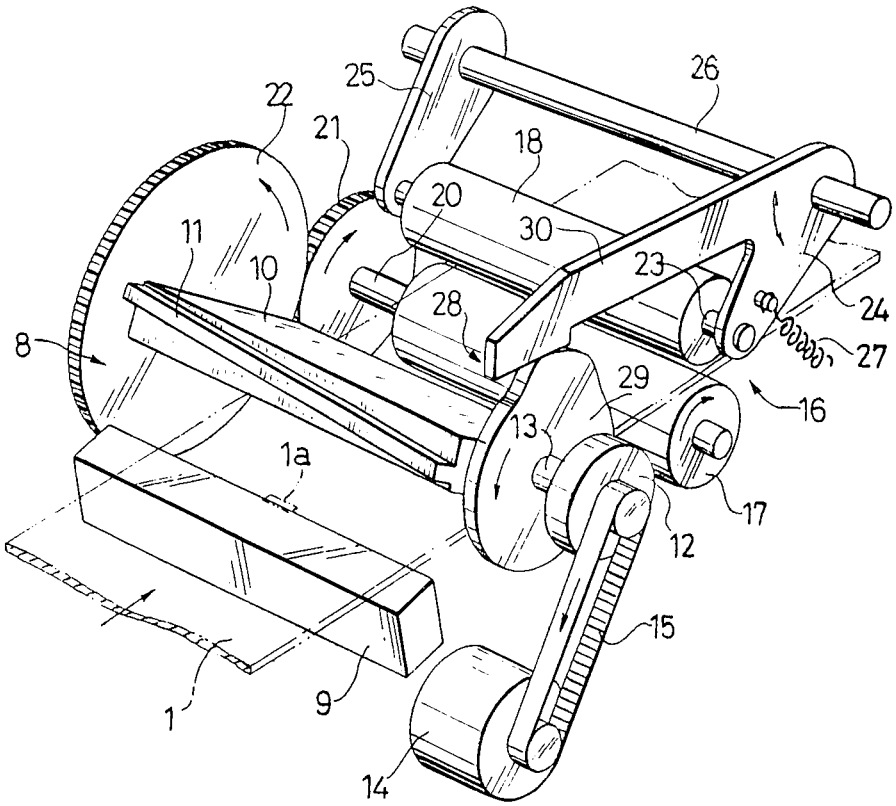
FIG. 2 is a perspective view showing the main part of the apparatus shown in FIG. 1.

Referring to FIGS. 1 and 2, a strip 1 of tags 2 fed from a continuous tag supply section (not shown) is intermittently conveyed in the direction of the arrow by a first feeding mechanism 3. The first feeding mechanism 3 comprises a driving roller 6 and a driven roller 7. The driving roller 6 is coupled to a pulse motor 5 through a timing belt 4. The driven roller 7 is brought into tight contact with the driving roller 6 through the strip 1. The strip 1 is fed upon operation of the pulse motor 5.

The strip 1 conveyed by the first feeding mechanism 3 is cut into individual tags 2 by a cutting mechanism 8. The cutting mechanism 8 comprises a stationary blade 9 and a rotary blade 10. The rotary blade 10 cooperates with the stationary blade 9 for cutting the strip 1. The rotary blade 10 is mounted on a rotating shaft 13 coupled to a one-revolution clutch 12. The rotary blade 10 has a blade member 11 which is obliquely formed on its one side. The one-revolution clutch 12 is coupled through a timing belt 15 to an AC motor 14 which rotates continuously. The clutch assures that the blade stops rotating at its position just before a cut is to be made and that the blade only makes a single cut per tag. Therefore, the rotary blade 10 is intermittently rotated, every time the one-revolution clutch 12 permits one revolution of the blade.

Each tag 2 cut by the cutting mechanism 8 is conveyed by a second feeding mechanism 16 which comprises a driving roller 17 and a cooperating driven roller 18, which press against the cut tag, and the cut tags are sequentially fed to and stacked in a stacker 19. The driving roller 17 is mounted on a rotating shaft 20 which is coupled to the rotating shaft 13 by gears 21 and 22, such that the driving roller 17 rotates only while the rotary blade 10 is rotating. But because the driven roller 18 is initially held away from the driving roller 17 during tag strip cutting, as described below, the tag then at the second feeding mechanism is not harmed by this rotation of the driving roller. The driven roller 18 is fixed on a rotatable shaft 23 and is pivotably supported by a pair of pivot levers 24 and 25. The pivot levers 24 and 25 are mounted on a shaft 26. A spring 27 is mounted on the pivot lever 24 to normally urge the driven roller 18 toward the driving roller 17.

A feed control mechanism 28 is mounted between the cutting mechanism 8 and the second feeding mechanism 16 to bring the driven roller 18 into tight contact with or to separate it from the driving roller 17 and the tag between those rollers during the movement of the rotary blade 10. The feed control mechanism 28 comprises a cam 29 and an engaging lever 30. The cam 29 is mounted on the rotating shaft 13. The cam has two sections, a larger radius, but shorter arcuate length, first section and a smaller radius, longer arcuate length second section. The engaging lever 30 is formed integrally with the pivot lever 24 and has one end thereof serving as a cam follower engaging with the cam 29. The positional relationship between the cam 9 and the engaging lever 30 is set such that the engaging lever 30 is urged upward by larger radius first section of the cam 29 during the time from when the rotary blade 10 is about to stop rotating, which is just prior to the blade cutting the tag strip, through the time when cutting of the strip 1 is about to be concluded. While the engaging lever 30 is held upward, the driven roller 18 is separated from the driving roller 17. After the tag strip is cut, the blade 10 continues its rotation and the lever 30 engages the second smaller radius section of the cam. Now, the driven 18 and driving 17 rollers are engaged through the tag between them.

Figure 3:
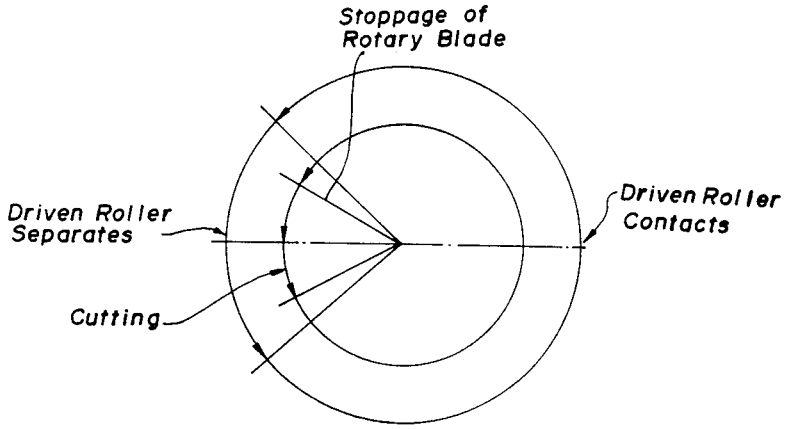
FIG. 3 shows the operating relationship between a cutting mechanism and a second feeding mechanism of the apparatus shown in FIG. 1.

The relationship between the position of the rotary blade 10 and the position of the driven roller 18 relative to that of the driving roller 17 are illustrated in FIG. 3. This Figure shows that when the rotary blade is rotating before it reaches the cutting position, the driven and driving rollers are engaged. Then the driven roller separates from the driving roller. Then the blade stops shortly before making its cut. The tag strip is fed by the first feeding mechanism. Next, the blade 10 rotates again and makes its cut and continues to rotate through the next cycle. After the tag strip is cut, the driven roller 18 again engages the driving roller 17. Therefore, just before and during the rotation of the blade for cutting, the driven roller 18 is disengaged, and it reengages just after the cutting.

A photosensor 31 shown in FIG. 1 detects an aperture 1*a* formed in each tag 2 of the strip 1. In response to a detection signal from the photosensor 31, the first feeding mechanism 3 is stopped and the cutting mechanism 8, and particularly its blade 10, is started by a signal from control means 32, which may be any suitable control means of the type known in the art.

The cutting and feeding operations of the continuous tag cutting/feeding apparatus having the above-described construction are now described.

While the rotary blade 10 is stopped just prior to its tag strip cutting, the engaging lever 30 engages the wider radius upper portion of the cam 29 and the lever 30 is urged upward or clockwise in FIG. 1. The driven roller 18 of the second feeding mechanism 16 is pivoted down and separated from the driving roller 17, as indicated by the solid line in FIG. 1. Both the cutting mechanism 8 and the second feeding mechanism 16 are ready for the tag strip to be fed.

When the pulse motor 5 is started, the strip 1 is properly fed by the first feeding mechanism 3 past the cutting mechanism to the second feeding mechanism. During feeding of the strip 1, when the photosensor 31 detects the aperture 1*a*, the pulse motor 5 is stopped. As a result, the strip 1 is also stopped. The photosensor 31 and/or the apertures 1*a* are so placed that in this condition, the leading end of the strip 1 has reached the second feeding mechanism 16. Since the driven roller 18 is sufficiently separated from the driving roller 17, the leading end of the strip 1 is smoothly inserted between them.

The strip 1 is stopped, and the rotary blade 10, the cam 29 and the driving roller 17 of the second feeding mechanism 16 are simultaneously actuated every time the one-revolution clutch 12 is rotated by one revolution. At this time, the driven roller 18 is still separated from the driving roller 17. Upon rotation of the rotary blade 10, the strip 1 is cut to obtain a tag 2. The engaging lever 30 next moves along the smaller diameter, lower portion of the cam 29 immediately after the strip cutting is completed, so that the engaging lever 30 is moved downward or counterclockwise by the biasing force of the spring 27, as indicated by the alternate broken line in FIG. 1. As a result, the driven roller 18 urges the cut tag 2 so as to clamp it against the driving roller 17. The tag 2 is properly delivered by the second feeding mechanism 16 into the stacker 19.

It should be noted that the strip 1 slips with respect to the driving roller 17 while the rotary blade 10 is being operated. However, since the driven roller 18 is not brought into tight contact with the driving roller 17 through the tag 2, the tag 2 may not be rubbed and smeared or contaminated by the driving roller 17. Furthermore, the strip 1 may not tear immediately before the corresponding cutting procedure is completed.

The one-revolution clutch 12 is actuated when the rotary blade 10 is rotated through one revolution. The rotary blade 10, the cam 29 and the driving roller 17 are then stopped. The engaging lever 30 engages with the upper, larger diameter portion of the cam 29 immediately before the rotary blade 10 is stopped, and the driven roller 18 is separated from the driving roller 17 while the rotary blade 10 is stopped. During this stopped period, the pulse motor 5 moves the tag strip into the position to be cut.

The above operation is repeated to sequentially cut the strip 1 into tags 2. The tags 2 are sequentially stacked in the stacker 19.

In the above embodiment, the feed control mechanism 28 is exemplified by a combination of the cam 29 and the engaging lever 30. However, a transmission mechanism such as a link mechanism may be used to separate the driving roller 17 from the driven roller 18 while the rotary blade 10 is stopped and cutting is performed. Alternatively, a predetermined number of detectors may be used to detect stopping of the rotary blade 10 and cutting of the strip 1. In this case, the driving roller 17 is separated from the driven roller 18 using a solenoid actuated in accordance with detection signals from the detectors.

The continuous tag cutting/feeding apparatus of the present invention has the feed control mechanism 28 which serves to separate the driving roller 17 and the driven roller 18 of the second feeding mechanism 16 while the rotary blade 10 is stopped and cutting is performed. Therefore, the strip 1 may not be damaged, smeared or contaminated by slipping between the rollers of the second feeding mechanism 16. Furthermore, the strip 1 may not accidentally tear immediately before cutting is completed. Since the strip 1 is smoothly inserted in a space between the driving roller 17 and the driven roller 18 which are separated from each other, the strip 1 may not be crumpled.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A continuous tag feeding and cutting apparatus, comprising:

a first feeding mechanism for feeding an uncut strip of tags;

a cutting mechanism placed for having the strip fed thereto and therepast by the first feeding mechanism; the cutting mechanism comprising a rotary blade supported on a shaft;

means connected with the shaft for periodically rotating the shaft to bring the rotary blade into engagement with the strip for thereby cutting the strip fed to the cutting mechanism;

a second feeding mechanism located after the cutting mechanism in the path of the tag strip for having the strip fed thereto by the first feeding mechanism and for feeding a tag cut from the tag strip; the second feeding mechanism comprising a driving roller for rotating and for engaging the strip to move the strip; drive means connected to the driving roller for driving the driving roller to rotate, the drive means being driven from the shaft as it rotates; and a driven roller movable into engagement with the driving roller for engaging the tag strip between the driving and the driven rollers and for moving the strip, and the driven roller also being movable off the driving roller for disengaging the tag strip so that the driving roller does not move the tag strip;

a feed control mechanism connected with the shaft and with the second feed mechanism for disengaging the second feed mechanism from a tag being cut while the rotary blade is moving and before the cutting of the tag strip and for reengaging the second feed mechanism with the cut tag after the cutting of the tag strip and while the blade is rotating beyond the position of cutting and is rotating around again toward the position of cutting for the next cut;

the feed control mechanism comprising a cam on the shaft and rotatable with the rotary blade; the cam having a first section and a second section; a cam follower connected with the driven roller and being engageable with one of the cam first and second sections; the cam follower being movable for moving the driven roller to engage the driving roller when the cam follower engages the first cam section, and the cam follower being movable for moving the driven roller to disengage from the driving roller when the cam follower engages the second cam section; the first cam section being located so as to engage the cam follower while the rotary blade is rotating from a position after tag cutting to a position prior to the next tag cutting, and the second cam section being located so as to engage the cam follower while the rotary blade is rotating from a position prior to tag cutting through the tag cutting to a position following tag cutting.

2. The apparatus of claim 1, wherein the shaft rotating means comprises a one-revolution clutch connected with the shaft and comprises continuous drive means connected with the clutch for driving the clutch, and the clutch being connected with the shaft for causing the blade to rotate through one revolution starting from prior to cutting the tag strip, through cutting the tag strip, and then back to the position prior to cutting the tag strip and then halting further rotation of the rotary blade, until after the second feed mechanism has reengaged with the tag strip.

3. The apparatus of claim 1, wherein the cutting mechanism further comprises a stationary blade positioned for being engaged by the rotary blade and for thereby cutting the tag strip where the rotary blade engages the stationary blade.

4. The apparatus of claim 1, wherein the first feed mechanism is further for feeding the tag strip past the cutting mechanism and to the second feeding mechanism when the second feeding mechanism is disengaged from the tag strip and prior to the rotary blade cutting the tag strip.

5. The apparatus of claim 4, wherein the first feeding mechanism further comprises sensing means for sensing the extent of feed of the tag strip and means responsive thereto for halting the feeding of the tag strip after a predetermined length thereof has moved past the cutting mechanism.

* * * * *